US005857708A

United States Patent [19]

Harvey

[11] Patent Number: 5,857,708

[45] Date of Patent: Jan. 12, 1999

[54] METHOD AND DEVICE FOR CONCURRENTLY CALENDARING APPOINTMENTS

[76] Inventor: Michael Wendell Harvey, 3031 N. Wolfcreek Dr., Eden, Utah 84310

[21] Appl. No.: 862,111

[22] Filed: May 22, 1997

[51] Int. Cl.[6] ..... B42D 15/00

[52] U.S. Cl. ..... 283/67; 283/58; 283/66.1; 283/2

[58] Field of Search ..... 283/2, 67, 70, 283/48.1, 57, 58, 60.1, 66.1, 115

[56] References Cited

U.S. PATENT DOCUMENTS

| | | | |
|---|---|---|---|
| 371,126 | 10/1887 | Currie . | |
| 436,147 | 9/1890 | McNamar . | |
| 981,066 | 1/1911 | Crary et al. . | |
| 2,536,371 | 5/1951 | Hutchinson | 283/58 |
| 3,625,546 | 12/1971 | Evans . | |
| 4,794,711 | 1/1989 | Christensen | 283/2 X |
| 5,308,119 | 5/1994 | Rushkoff | 283/58 |
| 5,387,011 | 2/1995 | Freund | 283/2 |
| 5,427,413 | 6/1995 | Ganza | 283/58 X |
| 5,636,874 | 6/1997 | Singer | 283/58 X |

*Primary Examiner*—Willmon Fridie, Jr.
*Attorney, Agent, or Firm*—Thorpe, North & Western, LLP

[57] ABSTRACT

A method and device for concurrently calendaring an appointment or event between at least two persons comprises selecting a recording instrument having a check format. The recording instrument may be a check book folder, pocket calendar, or electronic calendar device. The check format has blank lines for entering at least the names of the persons, a date and time, and a signature line. The date and time are entered on the check format. The names of the persons are applied to the check format. A signature of at least one of the persons is obtained. The recording instrument is separated into at least two parts and the parts are distributed to the at least two persons involved. A bridging element may be provided that extends across the at least two parts of the check format for maintaining a symbolic connection between the at least two parts.

23 Claims, 4 Drawing Sheets

METHOD AND DEVICE FOR CONCURRENTLY CALENDARING APPOINTMENTS

BACKGROUND OF THE INVENTION

1. Field of the Invention

The present invention relates to a method and device for concurrently calendaring appointments or events with an increased level of commitment and value. More particularly, the present invention relates to a recording instrument having a transactional check format where the appointment information is recorded on the check format and then separated into at least two parts for at least two persons involved.

2. Prior Art

Within the last two decades, a heightened awareness of the value of time has occurred, with an attendant increased effort for conscience control of time. Time has become increasingly viewed as a primary resource or asset to be carefully monitored and programmed. Indeed, a large industry has developed around the concept of time management and has produced a host of motivational and instructive seminars and other materials to teach people how to manage, account, and/or prioritize their time. Other systems go further by aiding people in identifying and prioritizing the various categories of activities in their lives.

All these systems and associated materials have a primary objective of making the most of time. These systems endeavor to achieve these objectives with complex day planners, calendars, and electronic devices. The concept of time management has now become an icon for success in the business community, and even in private life. Most of these materials and systems allow for scheduling or calendaring of appointments or events while some provide for other aspects such as prioritizing tasks, accounting for time, etc. While these materials and systems may help the person using them to value and manage their time, they do little to influence other persons who are also involved in the appointment or event. Furthermore, these systems fail to help the person and those with whom the person associates or does business to place a higher value on a commitment to an appointment or event with this person.

Therefore, it would be advantageous to develop a method and device capable of making a person and those with whom the person associates more aware of the value of time. It would also be advantageous to develop a method and device capable of making a person more accountable for the person's time. In addition, it would be advantageous to develop a method and device capable of making a person and those with whom the person associated experience greater commitment to an appointment or event.

OBJECTS AND SUMMARY OF THE INVENTION

It is an object of the present invention to provide a method and device for concurrently calendaring appointments or events with an increased sense of commitment.

It is another object of the present invention to provide a method and device for concurrently calendaring appointments or events with an increased sense of value.

It is yet another object of the present invention to provide method and device for concurrently calendaring appointments or events with an increased sense of accountability.

It is a further object of the present invention to provide a system which combines time management with mechanical tools customarily applied to financial matters.

These and other objects and advantages of the present invention are realized in a method and a device for concurrently calendaring appointments or events between at least two persons by selecting a recording instrument having a transactional check format. The recording instrument may be a check book folder, a pocket calendar, day planner, or an electronic calendar device. The check format preferably has the appearance of a financial check to help convey the importance of time. The check format includes means for recording the names of the at least two persons, the date and time of the appointment or event, and a signature line. The date and time for the appointment are entered on the check format. The name of at least one of the persons is applied to the check format. The signature of at least one of the persons is obtained. The recording instrument is then separated into at least two parts. One part may be the check format while the other is a check register. Alternatively, one part may be the check format while the other is a pocket calendar, a day planner, or a recording in the electronic device. The final step is to distribute the at least two parts to the at least two persons involved.

A bridging element may be provided on the check format which extends across both of the at least two parts. The bridging element maintains a symbolic connection between the at least two parts. The at least two parts may be reunited at the appointment or event as confirmation of having kept a commitment.

A recording instrument in accordance with a preferred embodiment of the present invention comprises a check book folder having a check format and a register. The check format has the appearance of a typical financial check to help convey the value of time. The check format includes a means for recording the names of the at least two persons, a date and time of the appointment or event, and a signature line. The check format may also include a purpose or location. The recording instrument also has a preformed separation line for dividing the check into at least two parts. The recording instrument may have a bridging element which extends across the separation line for maintaining a symbolic connection between the at least two parts.

A recording instrument in accordance with an alternative embodiment comprises a check format and register disposed so that a duplicate check format is created on the register. In another alternative embodiment, the recording instrument has a check format and a register disposed on the side and connected to the check format. The register may be a calendar in a pocket calendar or day planner.

The recording instrument may also be an electronic calendar device. The check format may be disposed over a entry window on the device such that when the date, time, or name is written on the check format a simultaneous copy is recorded in the device. Alternatively, the date, time, or name may be recorded in the device by way of the entry window or a keypad, and then the check format may be generated by the device, such as by a printer.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Figure 1:
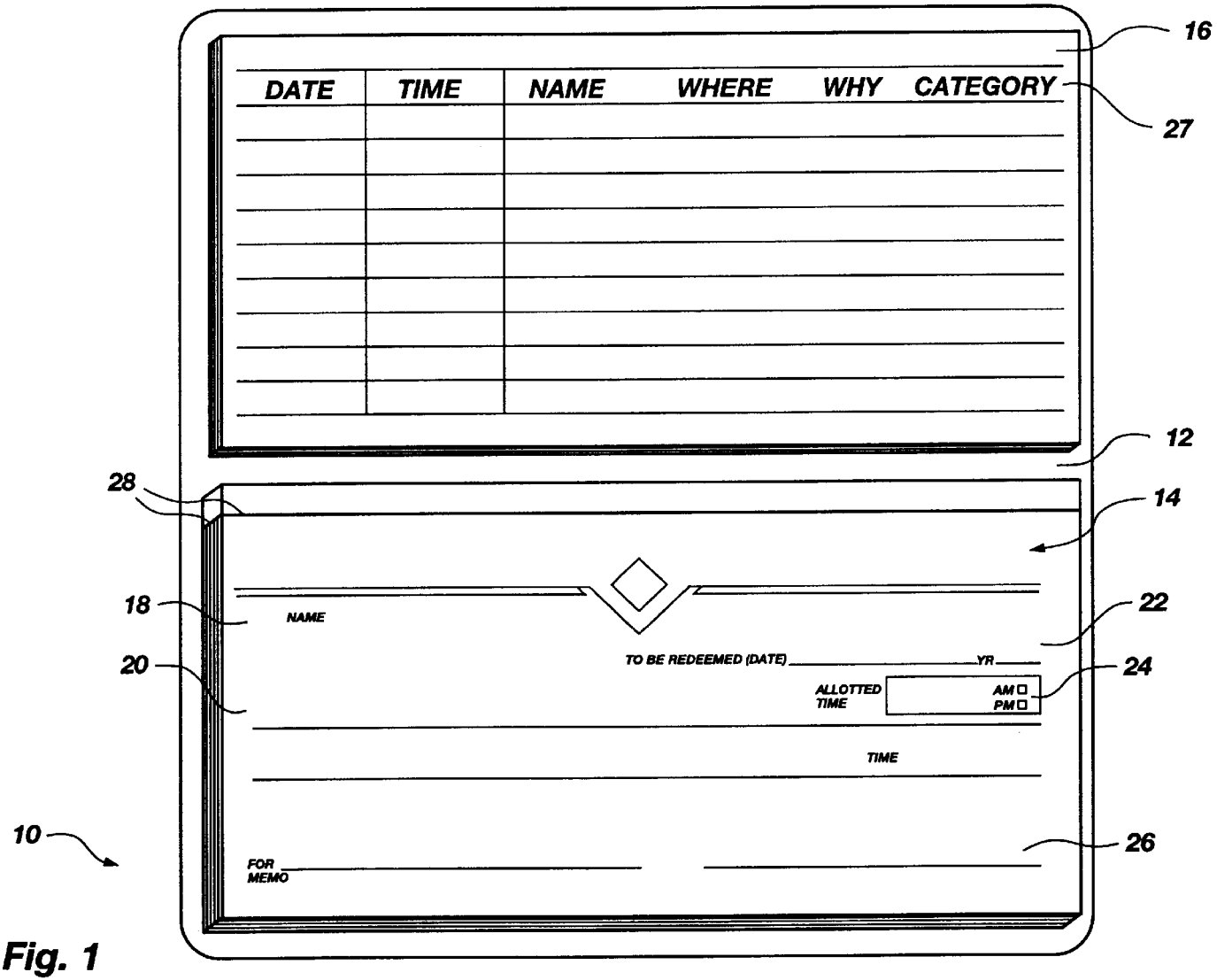
FIG. 1 is a top view of a recording instrument in accordance with a preferred embodiment of the present invention.

Reference will now be made to the drawings in which the various elements of the present invention will be given numerical designations and in which the invention will be discussed so as to enable one skilled in the art to make and use the invention.

The present invention includes a method for concurrently calendaring appointments or events with an increased sense of commitment and value. The method is used by at least two persons to be involved in the appointment or event. One of the at least two persons may be a controlling person in charge of calendering the appointments or events and another may be one who is being scheduled into the appointment or event as a scheduled person.

The appointment or event may be business related, such as a meeting or an interview, or may be personal, such as a dinner with a spouse or a ball game with a child. The calendaring method is used wherever and whenever an appointment or event is concurrently calendared or scheduled between two or more people and would otherwise be recorded by a memo, day planner, calendar, note, electronic pocket calendar, and the like, or simply unrecorded altogether.

The first step is to select a recording instrument that has transactional check format. The recording instrument may be a check book folder, similar to a typical, personal financial check book, or may be pocket calendar, like a day planner. In either case, a check format is included. The check format is preferably a paper check form forming individual appointment sheets. The paper check form is preferably perforated along a preformed separation line for dividing the recording instrument into at least two parts.

The check format has the appearance of a typical financial check book and is analogous to a real checking account system. Whereas a real check book represents a checking account holding a person's money and a check becomes negotiable by a drawor issuing a check drawn on a bank, the recording instrument represents an account of a person's time. Just as a real check represents something of value, namely money; the recording instrument is designed to represent another valuable asset, namely time. Thus, the appearance of the check format as a check helps to convey the importance of time.

The check-like appearance helps a person to manage their time, as they would their money, by accounting for it and being more frugal with it. When a person gives a check format "drawn" on their time, they will record it, as described below; they will feel as if they have given something of value; and they will respect the time as they would money. The check-like appearance also helps those with whom a person associates and does business to value the person's time. When a person receives a check format, they will feel as if they have received something of value and they will respect the time as they would money.

The check-like appearance also helps all persons involved in an appointment or event to keep their commitments. For example, when a salesman is given a check format for a meeting by a buyer, the salesman will realize that the buyer's time is valuable and keep the appointment. When a father gives his son a check format for a ball game, the father will realize that he has an obligation to attend the game with his son just like he has to pay a check.

The check format includes means for recording the names of the at least two persons to be involved in the appointment or event, a date and time for the appointment or event, and a signature line for a signature of at least one of the persons involved. The check format may also include the place or location for the appointment or event and the purpose of the appointment or event.

The recording instrument selected may be a paper check form which is perforated along a preformed separation line for dividing the recording instrument into at least two parts. This facilitates separation without tearing the paper in a haphazard manner. This not only enables a clean cut appearance, but adds a sense of professional image.

After the recording instrument is selected, the second step is to enter a date and time for the appointment on the check format. Obviously, this step focuses a sense of value on the specific appointment or event as if it were a money transaction.

The third step is to apply the names of the at least two persons to the check format. The name of the controlling person may be preprinted on the check format. The name of the scheduled person may be inserted on a blank line. Alternatively, blank lines may be provided for both the controlling person and the scheduled person. Of course, any number of lines may be provided.

The fourth step is to obtain a signature of at least one of the persons as acknowledgment of their commitment to attend the appointment or event. Either person may sign. The controlling person may sign much like the drawor would on a check. Or the scheduled person may sign. Typically, the scheduled person will be asked to sign as confirmation of this commitment.

The fifth step is to separate the recording instrument into at least two separate physical parts with each part containing the date and time of the appointment or event. This may be accomplished in several ways. The check format may have at least two parts and the date and time may be written on each of the parts of the check format. The recording device may have a check format and a register and the date and time may be written on the check format and on the register. The check format may have a self-duplicating register and the date and time may be written on the check format while a copy is simultaneously made on the register. The register may be a calendar in a pocket calendar or day planner. The recording instrument may have an electronic calendar device, as described below, and the date and time may be written on the check format while simultaneously recorded in the electronic device. The date and time may also be mechanically entered into the electronic device and the check format generated by the device. The recording instrument may be separated by tearing the paper check along the perforated separation line to form two separate parts to be retained by each person to attend the appointment or event.

The final step is to distribute the at least two parts to the at least two persons to be involved in the appointment or event. In this way, each person will have a copy of at least the date and time of the appointment or event.

An additional step may be included which comprises providing a bridging element which extends across both of the at least two parts of the check format. The bridging element maintains a symbolic connection between the at least two parts of the check format. The bridging element may be a logo, such as a company's trademark or a picture, or a slogan, such as a motivational quote like "Time Is Money."

Another additional step may be included which comprises reuniting the at least two parts of the check format at the appointment or event as confirmation of having kept a commitment to the appointment or event.

As described above, the recording instrument selected may be a pocket calendar, day planner, or a check book folder. Alternatively, the recording instrument selected may be an electronic calendar device. The electronic device may include a check format. The device may have an entry window and a display window. The check format may be disposed on the device so that at least a portion of the check format is disposed over the entry window such that while the date, time, and name are written on the check, they are simultaneously recorded in the electronic device. The entry window may be responsive to touch or to a special writing instrument. Alternatively, the date, time, and name may be entered into the electronic device by a keypad or the entry window, and then the check format may be generated by the device, such as by an integrated printer.

As illustrated in FIG. 1, a recording instrument for concurrently calendaring appointments or events in accordance with a presently preferred embodiment of the present invention is shown, generally indicated at 10. The recording instrument 10 is used by at least two persons to be involved in the appointment or event. One of the at least two persons may be a controlling person in charge of calendering the appointments or events and another may be one who is being scheduled into the appointment or event as a scheduled person.

The appointment or event may be business related, such as a meeting or an interview, or may be personal, such as a dinner with a spouse or ball game with a child. The recording instrument 10 is used wherever and whenever an appointment or event is concurrently calendared or scheduled between two or more people and would otherwise be recorded by a memo, day planner, calendar, note, electronic pocket calendar, and the like, or simply unrecorded.

The recording instrument 10 comprises a check book folder 12 having a transactional check format 14 and a check register 16 similar to a typical, personal financial check book. Alternatively, the recording instrument may be a pocket calendar or day planner and the register may be a calendar in the pocket calendar or day planner. The folder 12 has the appearance of a real, typical, financial check book and is analogous to a real checking account system. Whereas a real check book represents a checking account holding a person's money and a check becomes negotiable by a drawor issuing a check drawn on a bank, the folder 12 represents an account of a person's time. Just as a real check represents something of value, namely money, the folder and check format are designed to represent another valuable asset, namely time. Thus, the appearance of the folder as a check book and the check format as a check helps to convey the importance of time.

The check-like appearance helps a person to manage their time, as they would their money, by accounting for it and being more frugal with it. When a person gives a check format "drawn" on their time, they will record it, as described below; they will feel as if they have given something of value; and they will respect the time as they would money. The check-like appearance also helps those with whom a person associates or does business to value the person's time. When a person receives a check format, they will feel as if they have received something of value and they will hopefully respect the time as they would money.

The check-like appearance also helps all persons involved in an appointment or event to keep their commitments. For example, when a salesman is given a check format for a meeting by a buyer, the salesman will realize that the buyer's time is valuable and hopefully keep the appointment. When a father gives his son a check format for a ball game, the father will realize that he has an obligation to attend the game with his son just like he has to pay a check.

The check format is preferably a paper check form forming individual appointment sheets. The paper check form is preferably perforated along a preformed separation line for dividing the recording instrument into at least two parts.

The check format 14 has a means for recording names of the at least two persons to be involved in the appointment or event. The name of the controlling person is preprinted on the check format, indicated at 18. The preprinted scheduler name 18 may be located in the upper left hand corner of the check format as is done on a typical check with the drawor's name.

Alternatively, a blank line or box may be used for the scheduler name. A blank line allows the check format to be used by anyone and thus they may be produced and stored in bulk. A preprinted check format, however, is more formal and personal.

The name of the scheduled person is entered on a blank line, indicated at 20. The blank line 20 may be identified by words that are similar to the phase "Pay to the order of" on typical checks.

The date and the time of the appointment or event are entered on a date line and a time line, indicated at 22 and 24 respectfully. The date line 22 may be positioned as the date line is on a check. The time line 20 may be positioned as the amount line is on a check.

The check format also has a signature line 26. The signature line may be positioned as the signature line is on a check. The controlling person may sign the recording instrument on the signature line 26 like the drawor on a check. Alternatively, the scheduled person may sign the recording instrument on the signature line 26 as acknowledgment of a commitment to attend the appointment or event.

It is of course understood that the various lines and blanks may be configured in any number of ways. The configuration of a typical check is preferred as this enhances the appearance of value.

The recording instrument 10 has a register 16 similar to a check register. The register has rows for recording individual appointments or events and columns for recording specific information about the appointments or events, such as the name of the scheduled person, the date and time of the appointment or event, the location, the purpose, etc. The register may also have a column, indicated at 27, for categorizing or classifying the appointment or event as described more fully below. The register may be a calendar so that the person may enter the date, time, name, and other information of the appointment or event at the time the information is entered on the check format.

The check book folder 12 contains of a plurality of check formats bound together along an edge in the form of a pad. The check formats may be bound together in any way, such as by adhesive, staples, a ring binder, or the like. A preformed separation line 28 is formed on the check format for dividing the recording instrument into at least two separate physical parts, the individual check format and the check book folder with the register and remaining check formats. Each part contains the date and time of the appointment or event. One of the two separated parts is retained within the check book folder and another of the at least two parts is capable of being retained by the one of the at least two persons. The separation line may be perforated to ease dividing the recording instrument.

Figure 2:
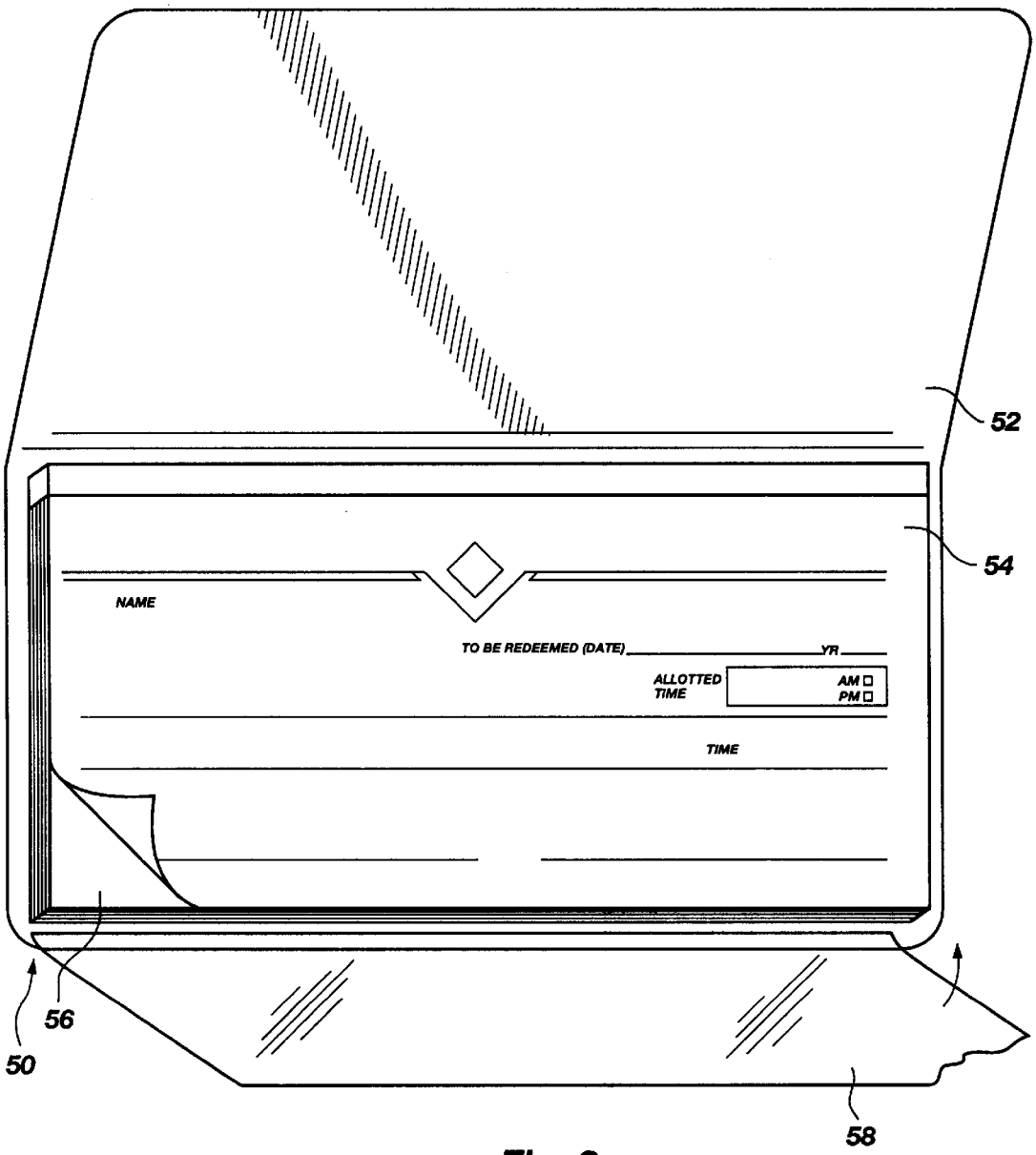
FIG. 2 is a top view of a recording instrument in accordance with an alternative embodiment of the present invention.

As illustrated in FIG. 2, a recording instrument for concurrently calendaring appointments or events in accordance with a first alternative embodiment of the present invention is shown, generally indicated at 50. The recording instrument 50 is similar to the preferred embodiment in that it comprises a check book folder 52 having a transactional check format 54. The folder 52 also has a check register 56 similar to a typical, duplicate check book. The check register 56 is disposed underneath the check format 54 such that a simultaneous duplicate of the check format is made on the register. A protective sheet 58 may be foldably attached to the folder 52 and insertable between the present register 56 and a subsequent check format to prevent a duplicate of the present check format from being made on subsequent registers.

Figure 3:
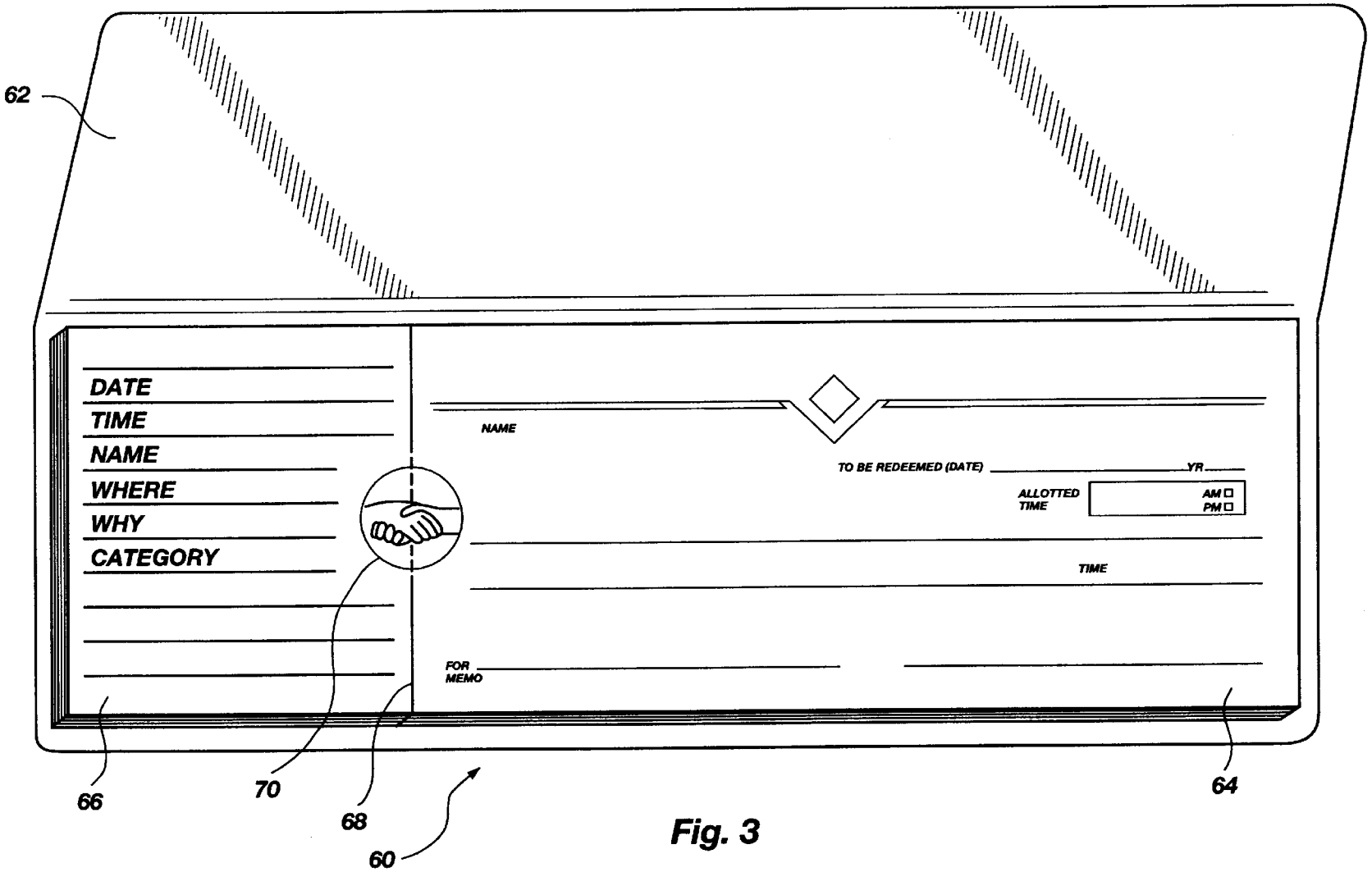
FIG. 3 is a top view of a recording instrument in accordance with an alternative embodiment of the present invention.

As illustrated in FIG. 3, a recording instrument for concurrently calendaring appointments or events in accordance with a second alternative embodiment of the present invention is shown, generally indicated at 60. The recording instrument 60 is similar to the preferred embodiment in that it comprises a check book folder 62 having a transactional check format 64. The folder 62 also has a check register 66 similar to a typical, business check book. The check register 66 is disposed to the side of the check format 64 and attached to the check format.

The register has blanks for recording the appointments or events and specific information, such as the name of the scheduled person, the date and time of the appointment or event, the location, the purpose, etc.

A preformed separation line 68 is formed on the check format for dividing the recording instrument into at least two separate physical parts, the check format 64 and the register 66 in the folder. Each part contains the date and time of the appointment or event. One of the two separated parts is retained within the check book folder and another of the at least two parts is capable of being retained by the one of the at least two persons. The separation line 68 may be perforated to ease dividing the recording instrument.

A bridging element 70 may extend across both of the at least two parts of the check format. The bridging element maintains a symbolic connection between the at least two parts of the check format. The illustrated handshake provides a symbol of commitment and integrity. The bridging element may also be a logo, such as a company's trademark or a picture, or a slogan, such as a motivational quote like "Time Is Money."

Figure 4:
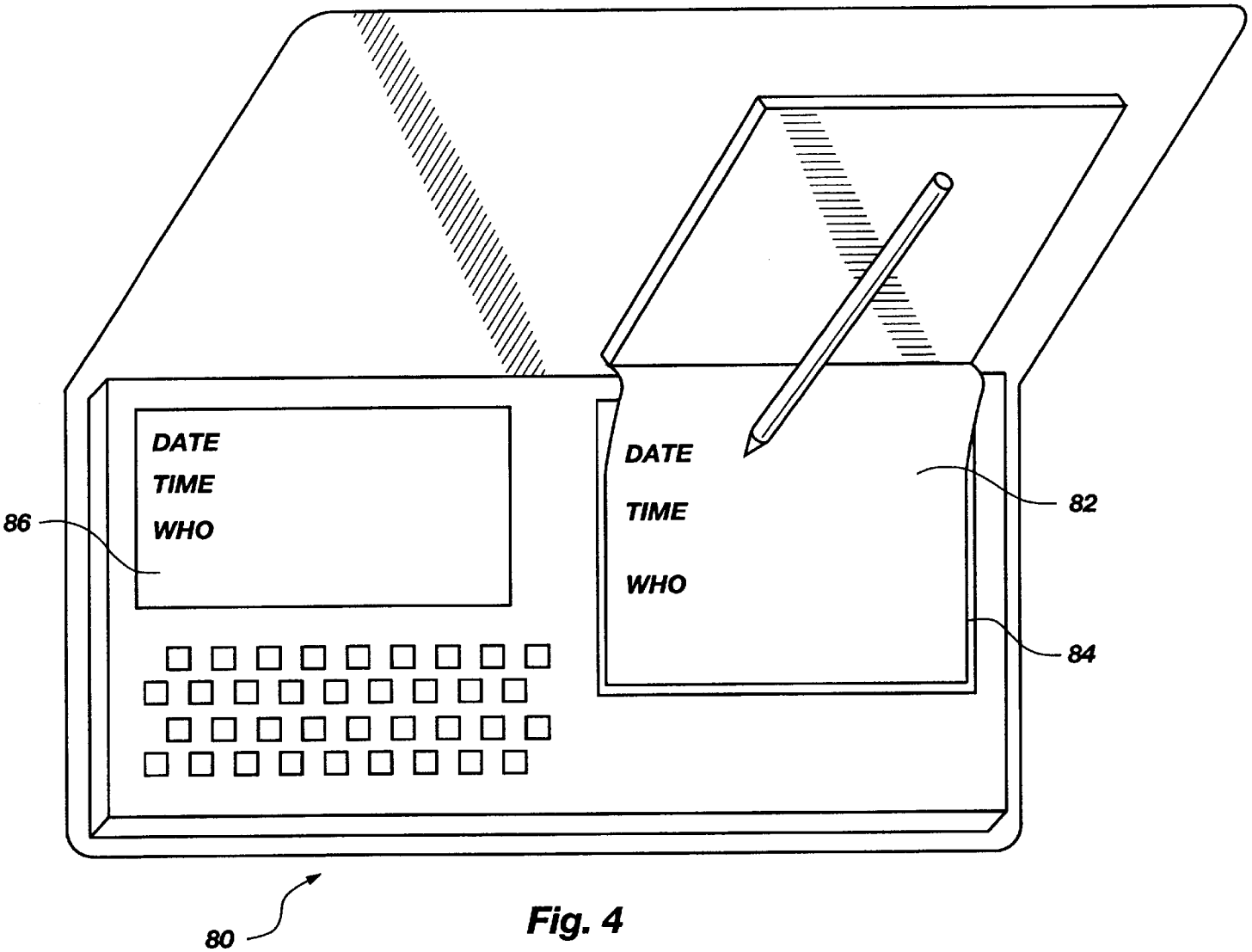
FIG. 4 is a top view of a recording instrument in accordance with an alternative embodiment of the present invention.

As illustrated in FIG. 4, a recording instrument for concurrently calendaring appointments or events in accordance with a third alternative embodiment of the present invention is shown, generally indicated at 80. The recording instrument 80 is an electronic calendar device. The electronic device may include a check format 82. The device may have an entry window 84 and a display window 86. The check format may be disposed on the device so that at least a portion of the check format is disposed over the entry window such that while the date, time, and name are written on the check, they are simultaneously recorded in the electronic device. The entry window may be responsive to touch or to a special writing instrument. Alternatively, the date, time, and name may be entered into the electronic device by a keypad or the entry window, and then the check format may be generated by the device, such as by an integrated or stand-alone printer.

A plurality of recording instruments may be provided in a pad with individual recording instruments being folded so that they are over the entry window. Alternatively, the recording instruments may be separated from the pad and disposed over the entry window. The device may have a pin corresponding to an aperture on the recording instrument or the recording instrument may fit in a slot on the device.

The names, date, time and other information may be entered into a computer and a computer program selected to assemble and analyze the information. For example, the person may enter the amount of time spent at an appointment or event along with the name or purpose for the appointment or event.

Further categories may be provided for categorizing the appointment or event, such as family, recreation, church, business, community, personal development, exercise/personal fitness, and the like. At the end of the week, month, quarter, and/or year, the amount of time and the particular categories may be transferred to the computer program where they are totaled and a report is generated. The report may take the form of a bank statement, and/or generate graphical representations of the catagories and amount of time spent in pie charts, bar graphs, and the like. The generated report would identify the amount of time spent for each particular category so that the person may determine where time is being spent and adjustments made. The computer program may contain suggestions for helping the person make the necessary adjustments. The computer program may also include a calender or planner.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A method for concurrently calendaring appointments or events with an increased sense of commitment and value, comprising the steps of:

a) selecting a recording instrument having a transactional check format including (i) means for recording names of at least two persons to be involved in the appointment or event, (ii) a date and time for the appointment or event, and (iii) a signature line for a signature of at least one of the persons involved;

b) entering a date and time for the appointment or event on the check format;

c) applying the names of the at least two persons to the check format;

d) obtaining a signature of at least one of the persons as an acknowledgment of a commitment to attend the appointment or event;

e) separating the recording instrument into at least two separate physical parts, each part containing the date and the time of the appointment or event; and f) distributing the at least two parts to the at least two persons to be involved in the appointment or event.

2. A method as defined in claim 1, wherein step a) comprises the more specific step of selecting a paper check form which is perforated along a preformed separation line for dividing into at least two parts.

3. A method as defined in claim 2, wherein step c) comprises the more specific step of having (i) a preprinted name on the check format representing one of the at least two persons who is a controlling person in charge of calendering the appointments or events and (ii) inserting a name of another of the at least two persons on a blank line who is being scheduled into the appointment or event as a scheduled person with the controlling person.

4. A method as defined in claim 3, wherein step d) comprises the more specific step of having the scheduled person sign as acknowledgment of a commitment to attend to the appointment or event.

5. A method as defined in claim 4, wherein step e) comprises the more specific step of tearing the paper check along the perforated separating line to form at least two separate parts to be retained by each of the at least two person involved in the appointment or event.

6. A method as defined in claim 1, further comprising the step of g) providing a bridging element which extends across both of the at least two parts of the check format.

7. A method as defined in claim 6, further comprising the step of h) reuniting the at least two parts of the check format at the appointment or event as confirmation of having kept a commitment to the appointment or event.

8. A method as defined in claim 1, wherein step a) comprises the more specific step of selecting a pocket calendar which includes the check format.

9. A method as defined in claim 1, wherein step a) comprises the more specific step of selecting an electronic calendar device which includes the check format.

10. A method as defined in claim 9, wherein step c) comprises writing at least one of the names on a check format attached to the electronic calendar device.

11. A method as defined in claim 10, wherein step b) concurrently enters the date and time on both the check form and in the electronic calendar device with a single entry step.

12. A method as defined in claim 3, wherein step d) comprises the more specific step of having the controlling person sign as acknowledgment of a commitment to attend to the appointment or event.

13. A device for concurrently calendaring appointments or events with an increased level of commitment and value, said device comprising:

a recording instrument having a transactional check format including (i) means for recording names of at least two persons to be involved in the appointment or event, (ii) a date and a time for the appointment or event, and (iii) a signature line for a signature of at least one of the persons involved; and a preformed separation line on the recording instrument for dividing the check format into at least two separate physical parts, each part containing the date and the time of the appointment or event.

14. A device as defined in claim 13, wherein the recording instrument comprises a check book folder which includes the check format.

15. A device for concurrently calendaring appointments or events with an increased level of commitment and value, said device comprising:

a recording instrument having a transactional check format including (i) means for recording names of at least two persons to be involved in the appointment or event, (ii) a date and a time for the appointment or event, and (iii) a signature line for a signature of at least one of the persons involved;

a preformed separation line on the recording instrument for dividing the recording instrument into at least two separate physical parts, each part containing the date and the time of the appointment or event; and a bridging element which extends across the separation line and which maintains a symbolic connection between the at least two parts of the recording instrument.

16. A device as defined in claim 15, wherein the recording instrument comprises a check book folder which includes the check format.

17. A device as defined in claim 16, wherein the check format is removable in individual appointment sheets which can be separated individually from the check book folder, and includes the preformed separation line for dividing the check format into the at least two separate parts.

18. A device as defined in claim 16, wherein one of the at least two separate parts is retained within the check book folder, and another of the at least two parts is capable of being retained by one of the at least two persons which does not retain the check book folder.

19. A device as defined in claim 1, wherein the bridging element comprises a single symbol which extends across the separation line and onto each of the at least two separate physical parts.

20. A device as defined in claim 1, wherein the recording instrument comprises electronic calendaring device and a paper format for written entry.

21. A device as defined in claim 1, wherein the preformed separation line on the recording instrument comprises a perforated line.

22. A device as defined in claim 15, wherein the recording instrument comprises a day planner which includes the check format.

23. A device as defined in claim 15, wherein the recording instrument includes means for categorizing the appointment or event; and further comprising means for transferring the categories to a graphical representation.

* * * * *